United States Patent [19]

Morton

[11] 4,442,427

[45] Apr. 10, 1984

[54] DOOR LOCKING ALARM DEVICE

[76] Inventor: David C. Morton, 3152 Curtis Dr., Flint, Mich. 48507

[21] Appl. No.: 391,531

[22] Filed: Jun. 24, 1982

Related U.S. Application Data

[63] Continuation-in-part of Ser. No. 244,294, Mar. 16, 1981, Pat. No. 4,358,758.

[51] Int. Cl.[3] ..... G08B 13/08

[52] U.S. Cl. ..... 340/546; 200/61.93; 292/339; 340/521; 340/686

[58] Field of Search ..... 340/546, 545, 521, 686; 200/61.93, 61.62; 292/338, 339

[56] References Cited

U.S. PATENT DOCUMENTS

| | | | |
|---|---|---|---|
| 1,695,686 | 12/1928 | Hess | 340/545 |
| 2,870,281 | 1/1959 | Mitchell | 292/339 |
| 4,036,518 | 7/1977 | Jost | 292/339 |
| 4,136,899 | 1/1979 | Frasher | 292/338 |
| 4,139,845 | 2/1979 | Washburn | 340/686 |
| 4,176,870 | 12/1979 | Cracraft | 292/338 |
| 4,258,359 | 3/1981 | McLamb | 340/521 |

*Primary Examiner*—Glen R. Swann, III
*Attorney, Agent, or Firm*—Harry R. Dumont

[57] ABSTRACT

A portable door lock and combined smoke and intrusion alarm has an upper forked end engageable with the door handle, a shaft extending in an adjustable length tube and terminating in a non-skid rubber end adapted to engage the floor or carpet. The upper end of the shaft is further retained in its mounted position by a retaining ring or cord. It has its lower end lying in a plane substantially aligned with the longitudinal axis of the shaft. A dual function alarm device is slidably mounted on the shaft and includes an actuator for it with a switch contact normally abutting or close to abutment with the surface of the door at a point below the door handle. Responsive to inward movement and pressure on the door the alarm will be actuated. At the same time, the locking action of the shaft and the upper forked end will divert the opening inward forces into forces directed against the floor so that the door cannot be opened. The alarm device is also actuable by an electrically controlled smoke alarm mounted adjacent to it.

10 Claims, 6 Drawing Figures

DOOR LOCKING ALARM DEVICE

REFERENCE TO RELATED APPLICATION

This application is a continuation-in-part of my U.S. application Ser. No. 244,294 filed on Mar. 16, 1981, for "Door Locking Alarm Device", now U.S. Pat. No. 4,358,758 issued Nov. 9, 1982.

BACKGROUND OF THE INVENTION

The present invention relates to a door locking device that is portable and easily adjustable in length to protect a wide variety of door openings. The door locking device further includes an alarm built integrally with it and having its own power source so that the alarm can be readily installed concommitantly with the installation of the door locking device. A probelm exists with respect to single door entry units such as hotels and motels in which a number of keys may be available to third parties other than management. Also in a number of cases the doors and the door locks installed by themselves are deficient in providing very little resistance to heavy pressure. For example, the average door frame may provide only an ⅛" or ¼" of wood frame resisting inward pushing pressure on the door in its locked condition.

The present invention is adapted to firmly and very strongly resist any inward opening pressure on the door. Inward pressure is diverted into a pressure against the floor and it has been found in practice that, before the door can be fully opened with a locking device according to the present invention, it would be necessary to literally force the door itself off its hinges.

An important feature of the present invention is the incorporation of an alarm device which will be operated after limited movement of the door and independently of the locking action. Thus, the person who has installed the portable alarm on his door is given an alarm that someone is seeking entry even before the door has been far moved.

The present invention is particularly important since it is adapted to engage existing parts of the door, namely the door handle and to operate directly against the flooring material whether it be carpet, rug or tile.

A still further feature of the invention is its protection against fire afforded by a smoke alarm device. The actuator for sounding the intrusion alarm may also operate as a test button for the smoke alarm and its power supply.

A number of prior art devices are known which are designed to lock doors against entry. These generally involve complicated arrangements and permanent installations of the locking device with respect to the door and to the floor.

U.S. Pat. No. 1,695,686 issued on Dec. 18, 1928 to S. P. Hess for "Door Secure" shows one such type of door securer. It will be seen that the alarm device is separately mounted and installed in the door and it requires a relatively complicated arrangement and is certainly not portable. The securing device itself requires a declivity in the floor and a permanent installation on the inner surface of the door. The present invention overcomes these major disadvantages and provides a single portable unit operable both to secure the door and to give the necessary alarm.

U.S. Pat. No. 2,870,281 issued on Jan. 20, 1959 to F. E. Mitchell for "Burglar Alarm" shows another type of burglar alarm including a locking device with alarm.

The alarm however is a telescoping alarm and it requires substantial movement of the door and locking device before there is provided an audible alarm. Also it will be seen that the primary and indeed only operative object of the device is to give an alarm. There is not provided the resistance required to afford concommitant locking against the door opening. Also the arrangements shown in this patent is far less portable and adaptable to moving or installation in any available housing unit.

A still further alarm apparatus operable along with a door is shown and described in U.S. Pat. No. 4,139,845 issued on Feb. 13, 1979 to A. F. Washburn. This patent discloses a tip-over type alarm adapted to be in contact with a closed door and to be tipped over by attempted entry. The device is a dual type device being both an alarm and a flashlight. It does not however during its operation as an alarm also give a secure resistance against opening of the door as does the present invention.

None of the known prior art devices exercise the combined functions of intrusion and smoke alarm as well as lockout.

BRIEF SUMMARY OF THE INVENTION

The present invention will be seen to be a combined door locking and alarm device in which the several functions are performed by a relatively simple arrangement of parts. The device includes an adjustable length shaft having the alarm slidably mounted at its upper end and a non-skid lower end adapted to abut against the floor. A forked end is mounted on the upper end of the shaft so that as the door is opened the forces inward are translated into forces directed into the floor and there is thus an extremely strong resistance given to inward movement of the door.

BRIEF DESCRIPTION OF THE DRAWINGS

The present invention will now be described in conjunction with the accompanying specification and with reference to the drawings in which like numerals are used to identify like elements as they may appear throughout the several drawing figures and in which.

DETAILED DESCRIPTION OF THE PREFERRED EMBODIMENT

Figure 1:
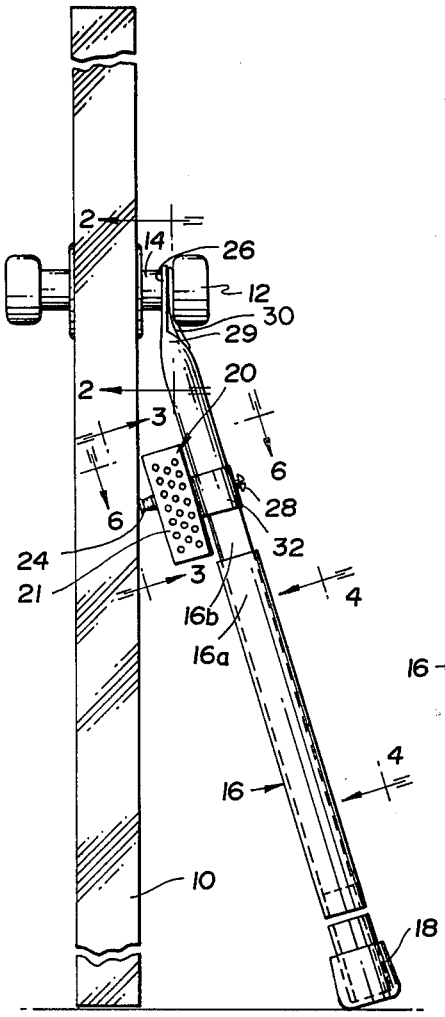
FIG. 1 is a side elevational view of a door and of the locking device with parts broken away.

FIG. 1 shows a door 10 in its closed position. The door 10 includes a conventional knob 12 connected to the central lock mechanism by a shaft 14. The locking and alarm device according to the present invention is indicated generally by the numeral 16. The locking device 16 is of a tubular type having an inner and outer sliding member with the numeral 16*a* for the external member and the numeral 16*b* indicating the internal slider. A non-skid end 18 is attached to the lower end of the locking device 16 to prevent its sliding movement across the floor when the door is opened.

There are several elements connected to the upper end of the shaft locking device 16 which include an electrically operated smoke alarm 20 of a type well known and commonly used and having a DC source incorporated with it for operation. In the interest of simplification and brevity, the detail of the alarm device 20 is not given. It includes an outer, perforated casing 21 to allow entrance of smoke particles. The alarm 20 includes an actuator in the form of a movable contact 24 adapted to bear against the inner surface of the door 10. Responsive to the closure of the normally open contact 24 there will be given an audible output from the alarm device 20. It will be seen that a very small amount of movement will be needed by the door 10 prior to there being an alarm given. If the audible alarm is not desired, the alarm 20 can be slid downwardly after loosening a thumb screw 28.

A forked end 26 is also mounted at the upper end of the tube 16*b*. The lower end of the forked end 26 is securely attached to the tube 16*b* transaxial but almost parallel to the tube at a point denoted by the numeral 29. It will be seen that the forked end 26 has an angular orientation with respect to the doorknob shaft 14 and the longitudinal axis of the tube 16*b* such that inward forces against the forked end 26 are translated into a downward vector of force and cause movement of the locking device shaft 16 into the floor. This affords tremendous resistance against the swinging movement of the door 10. Tests have indicated that the door must be pushed off its hinges before the locking device shaft 16 will be moved along the floor or broken. Also shown in FIG. 1 is a cord loop 30 used to attach the alarm device 20 to the doorknob shaft 14 and to allow for its storage in an inactive position against the inner door surface. It is important that the shaft 16 be adjustable in length since all doors are not uniform with respect to the height of their doorknob above the floor. Also in some cases, where the floor is relatively slippery, it may be required to have a slightly different angle of the forked end 26 to shaft 16 connection.

Figure 2:
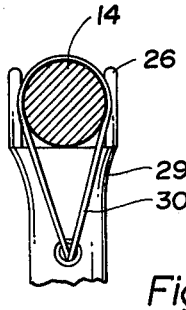
FIG. 2 is a sectional view of the handle taken along the lines 2—2 of FIG. 1 to show the upper forked end.

FIG. 2 shows the manner in which the forked end 26 is rather loosely fitted around the handle of the doorknob shaft 14 when the device is installed.

Figure 3:
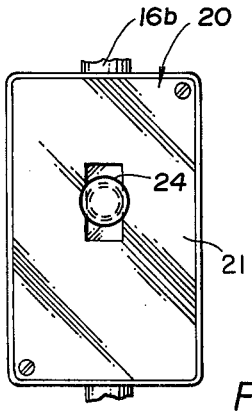
FIG. 3 is a view taken along the section lines 3—3 of FIG. 1 showing the actuator for the audible alarm.

FIG. 3 illustrates the manner in which the movable contact 24 extends inwardly from the casing 21 in the direction of the inner surface of the door 10. The alarm device 20 is attached to a sleeve 32. A screw 28 extends through a threaded opening in the sleeve 32 for tightening or loosening it. It will be understood that different types of alarms may be used in place of the audible alarm 20 such as a blinking light and audible alarm, all of which are electrically actuated in a manner well known in the art.

Figure 4:
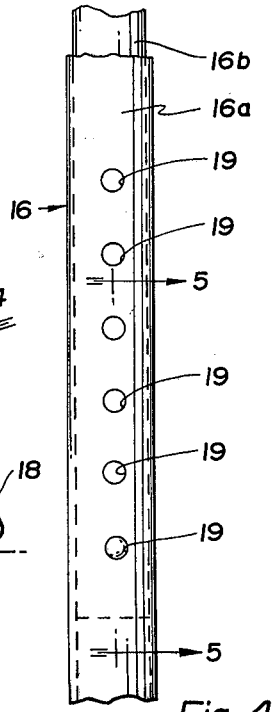
FIG. 4 is a frontal view taken along the section lines 4—4 of FIG. 1 showing a length of the adjustable length shaft.
Figure 5:
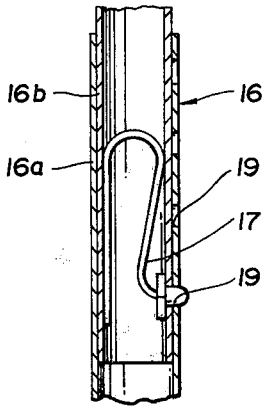
FIG. 5 is a cross-sectional view taken along the section lines 5—5 of FIG. 4 showing the engaging and locking element of the adjustable length shaft.

FIGS. 4 and 5 show the manner in which the two sliding tubes 16*b* and 16*a* are telescopically adjusted to size the length of the alarm device shaft. For this purpose a resiliently mounted plunger 17 is included and mounted on the inner surface of the sliding tube 16*b*. The plunger 17 is adapted to protrude in locking arrangement through a selected one of a plurality of spaced openings 19 along the length of the outer tube 16*a*. Thus the length may be adjusted by simply depressing the plunger 17 and moving the two tubes one relative to the other until the correct length and opening 19 is selected.

Figure 6:
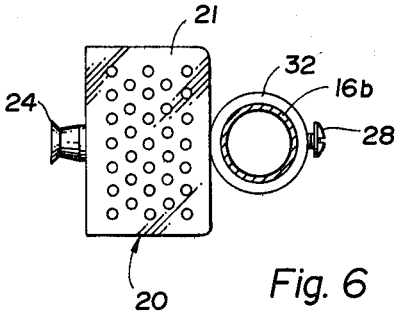
FIG. 6 is a partial cross-sectional view taken along the section lines 6—6 of FIG. 1 showing the basic alarm device and the manner in which it is slidably attached to the upper end of the shaft of the alarm device.

FIG. 6 shows the manner in which the casing 21 for the alarm 20 is fixed to the upper end of the tube 16*b* by the sleeve 32.

It is important with respect to the present invention that the device be light, compact and easily installable where desired. This makes it useful to travelers as well as to people using it in their own personal residence.

It will thus be seen that I have provided by my invention a combined door locking and alarm device which combines and performs the two functions with a fire alarm in a simple, straightforward and reliable manner and with a novel arrangement of parts unknown to the prior art.

I claim:

1. A door locking and alarm device for portable use and ready installation on a door handle comprising:

an adjustable length shaft portion;

a non-skid end portion mounted on the lower end of the shaft portion;

a door handle engaging end fixed to the upper end of said shaft portion and mounted on it substantially aligned to its longitudinal axis; and an alarm device slidably mounted on said shaft portion and having an actuator therefor movable away from and toward abutment with the inner surface to the door for providing an alarm responsive to a limited movement of the door inwardly.

2. The combination as set forth in claim 1 wherein said adjustable length shaft portion includes inner and outer telescoping sleeve portions and a plunger adjustably registerable with one of a plurality of holes longitudinally arranged in said tubes.

3. The combination as set forth in claim 1 wherein said alarm device is of the electrically operated, audible type and said actuator includes a movable contact mounted proximate the upper end of said shaft and normally placed in engagement with the inner surface of the door in the active condition of the alarm device.

4. The combination as set forth in claim 1 wherein a loop is included attached to the upper end of said shaft to allow its being stored in an inactive position against the inner door surface.

5. The combination as set forth in claim 1 wherein said alarm device is of the electrically operable type having its own electrical power source included.

6. The combination as set forth in claim 5 wherein said alarm device actuator comprises a normally open switch.

7. The combination as set forth in claim 1 wherein said door handle engaging end comprises a forked end operable to engage the shaft associated with a knob of said handle.

8. A door locking device for portable use and ready installation on a doorknob and doorknob shaft, comprising:

an adjustable length shaft portion;

a non-skid end portion mounted on the lower end of said shaft portion;

a forked end mounted at the upper end of said shaft portion and engageable about said doorknob shaft; and an alarm device slidably mounted on said shaft portion and having its actuator movable into and away from contact with said door inner surface.

9. The combination as set forth in claim 8 wherein said alarm device comprises a combination intrusion alarm and smoke alarm.

10. The combination as set forth in claim 9 wherein said actuator comprises a test button for said smoke alarm.

* * * * *